US006044976A

United States Patent [19]

Bandrowski et al.

[11] Patent Number: 6,044,976

[45] Date of Patent: Apr. 4, 2000

[54] HORIZONTAL STORAGE AND TRANSPORT CONTAINER

[75] Inventors: Stephen A. Bandrowski, Cliffside; Holt A. Murray, Jr., Hopewell; Martin T. Wislinski, Edison, all of N.J.

[73] Assignee: Tyco Submarine Systems, Ltd., Eatontown, N.J.

[21] Appl. No.: 09/244,997

[22] Filed: Feb. 10, 1999

[51] Int. Cl.[7] ..... B65D 85/02

[52] U.S. Cl. ..... 206/493; 206/303; 206/488; 206/565

[58] Field of Search ..... 206/303, 318, 206/486, 488, 493, 526, 562–565, 521, 588; 108/55.3

[56] References Cited

U.S. PATENT DOCUMENTS

| | | | |
|---|---|---|---|
| 1,498,245 | 6/1924 | Le May | 206/303 X |
| 2,258,535 | 10/1941 | Buranelli | 206/84 |
| 2,699,865 | 1/1955 | Bowen | 206/373 |
| 2,965,219 | 12/1960 | Rhodin | 206/488 |
| 3,080,964 | 3/1963 | Robinson et al. | 206/303 |
| 3,265,280 | 8/1966 | Butzko | 206/303 |
| 3,407,079 | 10/1968 | Griffith et al. | 206/499 X |
| 3,777,885 | 12/1973 | Barteck | 206/564 X |
| 4,347,947 | 9/1982 | Hammes . | |
| 4,666,037 | 5/1987 | Weissman | 206/588 X |
| 4,674,650 | 6/1987 | Hamilton et al. . | |
| 4,700,842 | 10/1987 | Grusin . | |
| 4,872,557 | 10/1989 | Ames . | |
| 4,905,834 | 3/1990 | Mur Gimeno et al. . | |
| 5,136,826 | 8/1992 | Carson et al. . | |
| 5,148,920 | 9/1992 | Walker | 206/588 |
| 5,213,211 | 5/1993 | Umiker . | |
| 5,234,104 | 8/1993 | Schulte et al. | 206/486 X |
| 5,312,011 | 5/1994 | Fischer . | |
| 5,316,207 | 5/1994 | Ross et al. . | |
| 5,409,128 | 4/1995 | Mitchell . | |
| 5,445,397 | 8/1995 | Evans . | |

FOREIGN PATENT DOCUMENTS

| | | | |
|---|---|---|---|
| 0073841 | 4/1984 | Japan | 206/303 |

*Primary Examiner*—Bryon P. Gehman

[57] ABSTRACT

A container holds an item. The item has an upper surface with a contacting portion and a non-contacting portion. The container comprises a base and a cover. The base has a lower retaining portion with a depth. The item is removably engagable into the lower retaining portion of the base. The cover has an upper retaining portion with a contacting portion and a non-contacting portion. The cover is removably engagable with the base so that the upper retaining portion of the cover is aligned with the lower retaining portion of the base. When the contacting portion of the upper retaining portion of the cover is engaged with the contacting portion of the item, the non-contacting portion of the upper retaining portion is separated from the non-contacting portion of the item by a gap.

13 Claims, 10 Drawing Sheets

HORIZONTAL STORAGE AND TRANSPORT CONTAINER

CROSS-REFERENCE TO A RELATED PATENT APPLICATION

This patent application is related to a commonly assigned U.S. patent application Ser. No. 09/244,771 entitled, Vertical Storage and Transport Container filed by the same inventors and is incorporated herein by reference.

BACKGROUND OF THE INVENTION

The present invention relates generally to storage and transport containers. More specifically, the present invention relates to restricted storage and transport containers which can store items with an upper surface that should be isolated during storage and transport.

The manufacture and assembly of products often involves components that require special handling due to the nature of the components. For example, product components are often prepared or processed by such techniques as cleaning, coating, anodizing, and/or chemical wet processing to name just a few. The components should be prepared in such a manner that at least a portion of the component and/or the overall product should to be handled, stored or transported without the portion being exposed to potential damage.

In the manufacture and assembly of telecommunications products, for example, one such component is an annulus plunger made of copper beryllium to promote the bonding of copper beryllium components with polyethylene components molded during an assembly process. During the manufacture of the plunger, its upper surface is prepared with an ebonizing process.

For this plunger to be effectively bonded to polyethylene, the ebonized upper surface of the plunger must be in pristine condition unchanged from that manufactured. This ebonized upper surface of the plunger, however, is susceptible to environmental damage such as oxidation and mechanical damage due to touching or contacting the ebonized surface. Consequently, the plunger should be stored and transported without the ebonized upper surface being exposed to potential damage.

One option for protecting the plunger during transport would be to place it within a container of some sort. Known containers, however, are designed to store items without regard to protecting a particular surface or section of the stored items. For example, U.S. Pat. No. 5,409,128 discloses a stackable container for holding heavy small objects and stacking multiple containers together without the stack separating when tilted or inverted. Similarly, U.S. Pat. No. 5,312,011 discloses a stackable container system having multiple containers which can snap together. These containers store items without protecting a specific surface or section of the stored item. Furthermore, these container systems allow individual containers to be stacked, but do not allow the items to be individually stacked within the container while protecting a particular surface or section of the stored item.

SUMMARY OF THE INVENTION

A container can hold an item or items. A container in accordance with the present invention holds a set of items, each of which has an upper surface with a contacting portion and a non-contacting portion. The container comprises a base and a cover. The base has a lower retaining portion with a depth. The item is removably engagable into the lower retaining portion of the base. The cover has an upper retaining portion with a contacting portion and a non-contacting portion. The cover is removably engagable with the base, the upper retaining portion of the cover is aligned with the lower retaining portion of the base. When the contacting portion of the upper retaining portion of the cover is engaged with the contacting portion of the item, the non-contacting portion of the upper retaining portion is separated from the non-contacting portion of the item by a gap.

In one embodiment, the contacting portion of the item is removably engagable with the contacting portion of the upper retaining portion of the cover without the non-contacting portion of the upper retaining portion contacting the non-contacting portion of the item.

In another embodiment, the contacting portion of the upper retaining portion of the cover has a first incline angle and the contacting portion of the item has a second incline angle greater than the first incline angle. The contacting portion of the upper retaining portion of the cover contacts the contacting portion of the item at a point.

In yet another embodiment, the contacting portion of the upper retaining portion of the cover has a first incline angle and the contacting portion of the item has a second incline angle substantially equal to the first incline angle.

BRIEF DESCRIPTION OF THE DRAWINGS

The various features of the invention will best be appreciated by simultaneous reference to the description which follows and the accompanying drawings, in which.

DETAILED DESCRIPTION

A container can hold a set of items. Each item can have an upper surface with a contacting portion and a non-contacting portion (see, e.g., FIGS. 7 and 8 which are discussed below). The item can be, for example, an annulus plunger that has an upper surface prepared with an ebonizing process; the upper surface has a contacting portion that can be contacted without damage and a non-contacting portion that should not be exposed to damage. The container allows the plunger to be stored and transported without the ebonized upper surface (i.e, the non-contacting portion) being exposed to potential damage.

Of course, the item can have different configurations such as different shapes, heights, and sizes, and contacting portion and non-contacting portion shapes. For example, the item can have an interior hole with, for example, a circular shape or rectangular shape.

Figure 1:
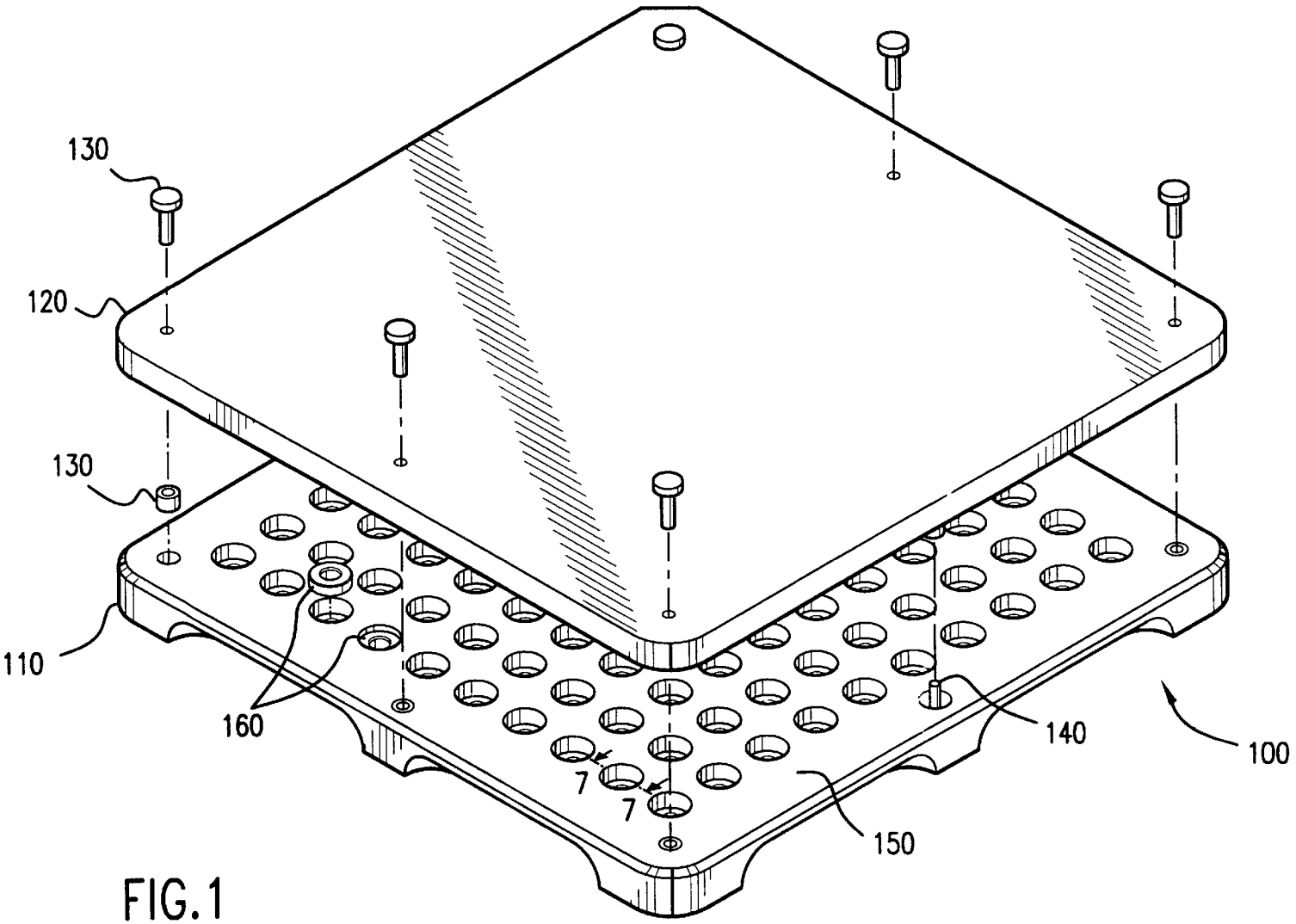
FIG. 1 illustrates an isometric view of a storage and transport container according to embodiment of the present invention.

FIG. 1 illustrates an isometric view of a storage and transport container according to embodiment of the present invention. Container 100 includes base 110, cover 120, clamping members 130. Base 110 includes alignment pins 140. Base 110 and cover 120 can be made of, for example, any appropriate rigid plastic such as Lexan®. Each clamping member 130 can be, for example, a knob and receptacle arrangement; the receptacle can be located in base 110 and can removably engaged by the knob through cover 120 so that base 110 and cover 120 are clamped together. Alignment pins 140 can be used to align cover 120 with base 110 when cover 120 is closed upon base 110. Although container 100 is shown with a square planar shape, other shapes are possible, such as a circular shape and non-planar shapes where the shape of cover 120 compliments the shape of base 110.

Base 110 of container 100 includes a set of lower retaining portions 150 into which an item 160 can be placed for storage and transport. In other words, an item 160 can be placed into a corresponding recess 150. Lower retaining portions 150 have a depth 151 which is greater than the height of items 160.

Figure 2:
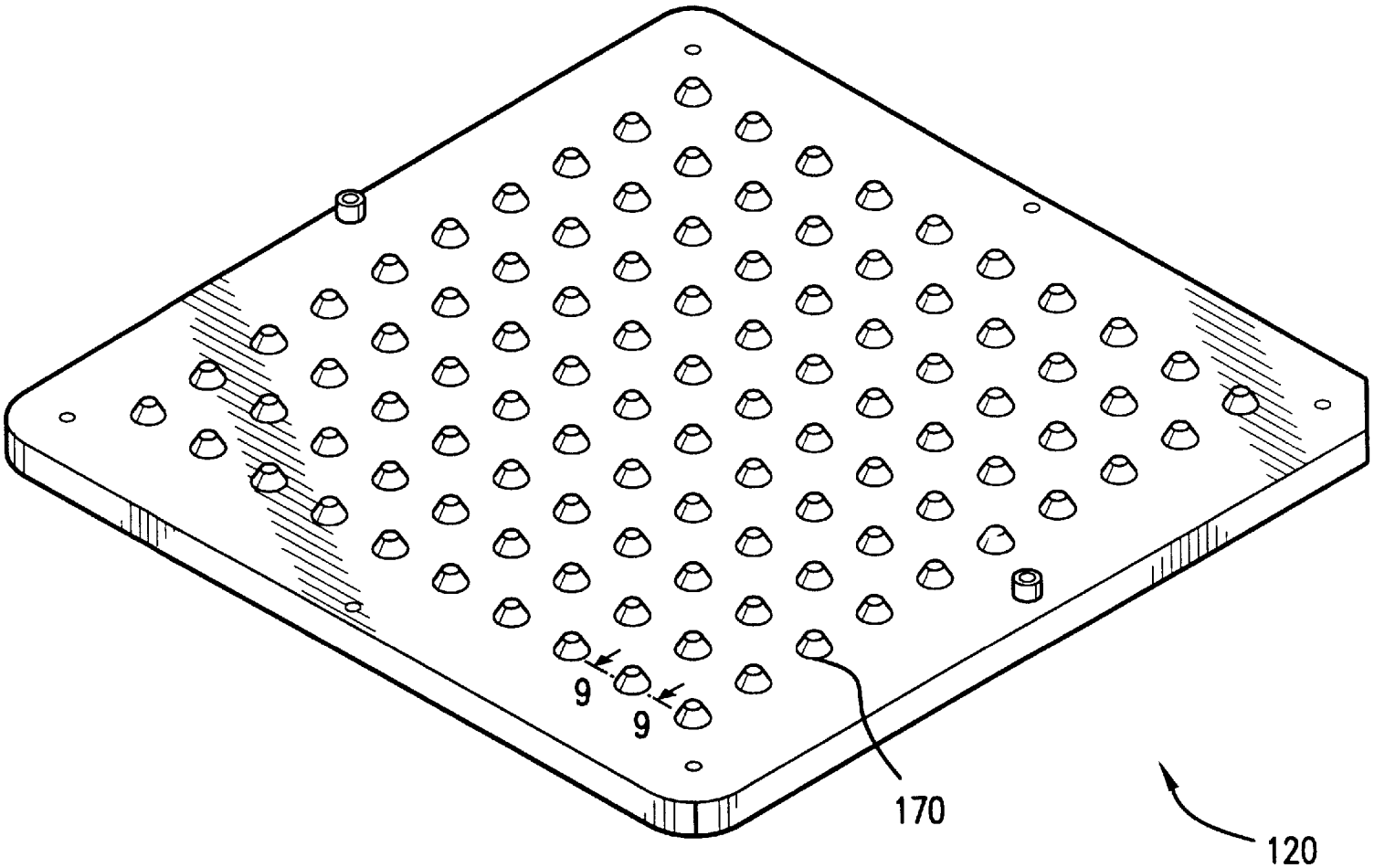
FIG. 2 illustrates an isometric view of the cover of the storage and transport container shown in FIG. 1.
Figure 3:
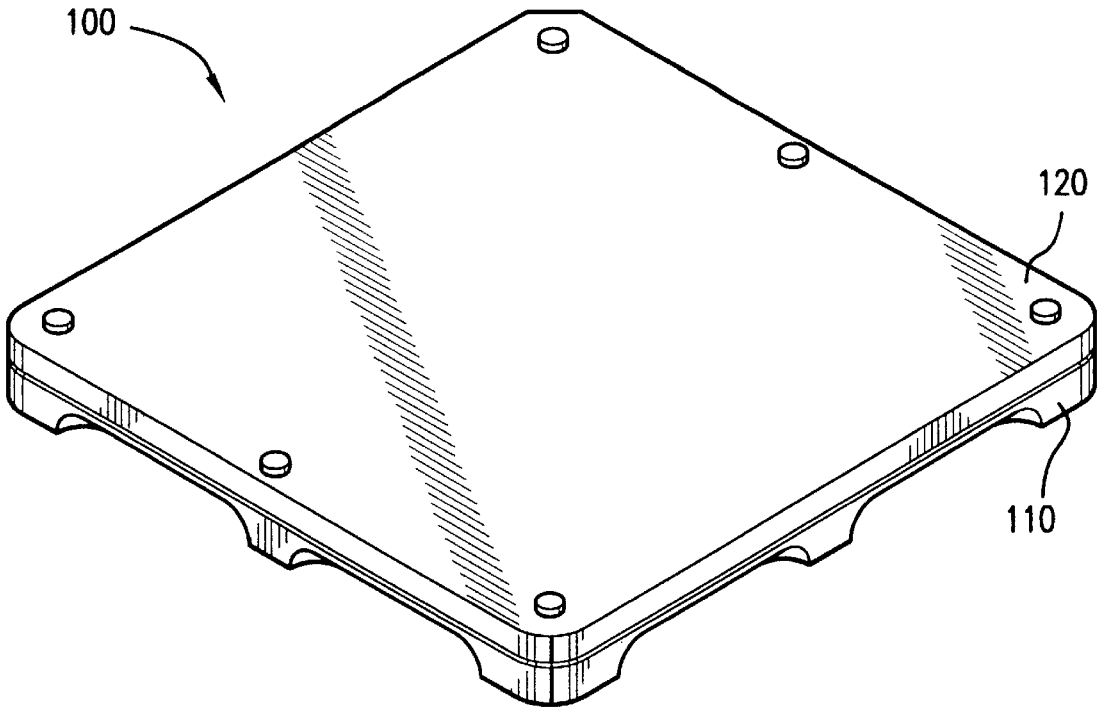
FIG. 3 illustrates an isometric view of the storage and transport container shown in FIG. 1 when the cover is closed onto the base.

FIG. 2 illustrates an isometric view of the cover of the storage and transport container shown in FIG. 1. Cover 120 includes a set of upper retaining portions 170 which align with the lower retaining portions 150 of the base 110 to secure items 160 when cover 120 is closed onto base 110. FIG. 3 illustrates an isometric view of the storage and transport container shown in FIG. 1 when the cover 120 is closed onto the base 110.

Figure 4:
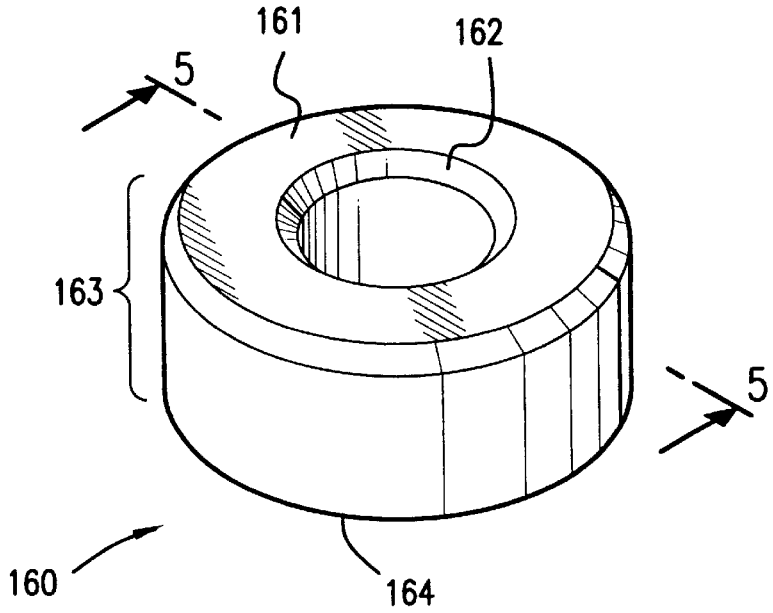
FIG. 4 illustrates an isometric view of an embodiment of an item that can be used with the storage and transport container shown in FIG. 1.
Figure 5:
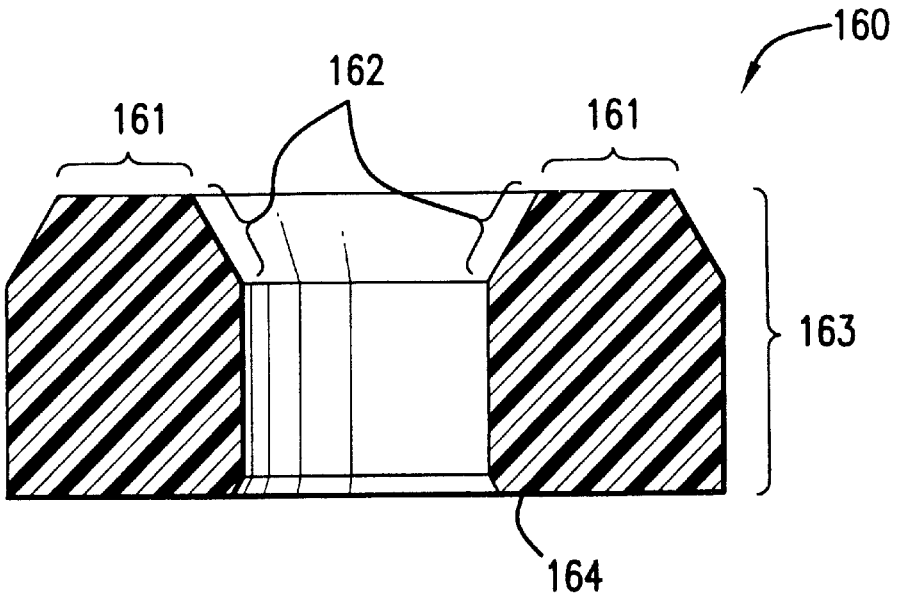
FIG. 5 shows a cross-sectional view along line 5 of the item shown in FIG. 4.

FIG. 4 illustrates an isometric view of an embodiment of an item that can be used with the storage and transport container shown in FIG. 1. FIG. 5 illustrates a cross-sectional view along line 5 of the item shown in FIG. 4. Item 160 includes non-contacting portions 161 and contacting portions 162. Item 160 also includes a side 163 having a height that can be measured between an interior base 164 of item 160 to the non-contacting portion 161.

Figure 6:
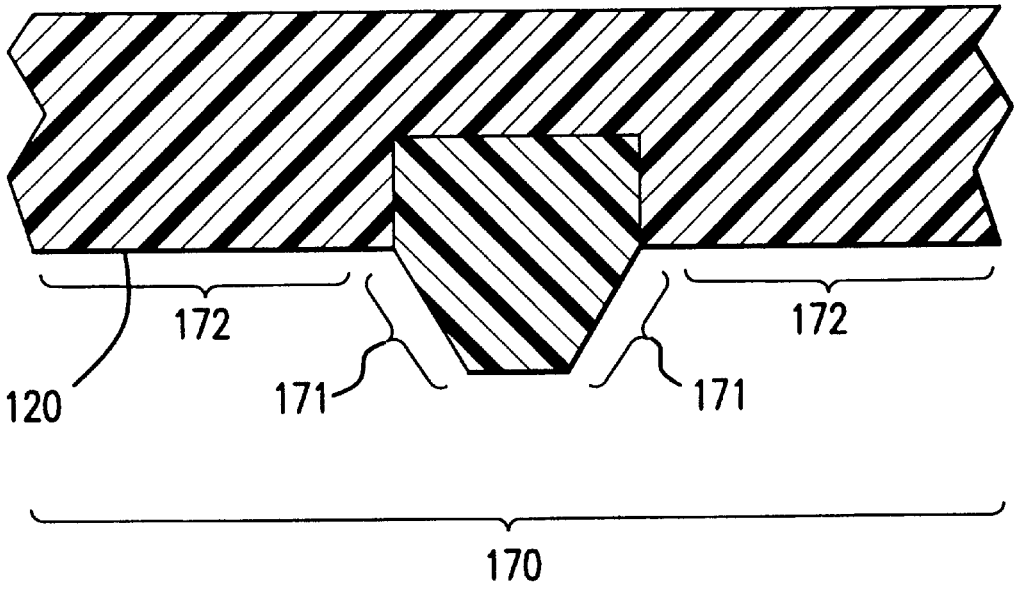
FIG. 6 illustrates a cross-sectional view along line 9 of a portion of the cover for the storage and transport container shown in FIG. 1.

FIG. 6 illustrates a cross-sectional view along line 9 of a portion of the cover for the storage and transport container shown in FIG. 1. As shown in FIG. 6, upper retaining portions 170 includes contacting portions 171 and non-contacting portions 172.

Figure 7:
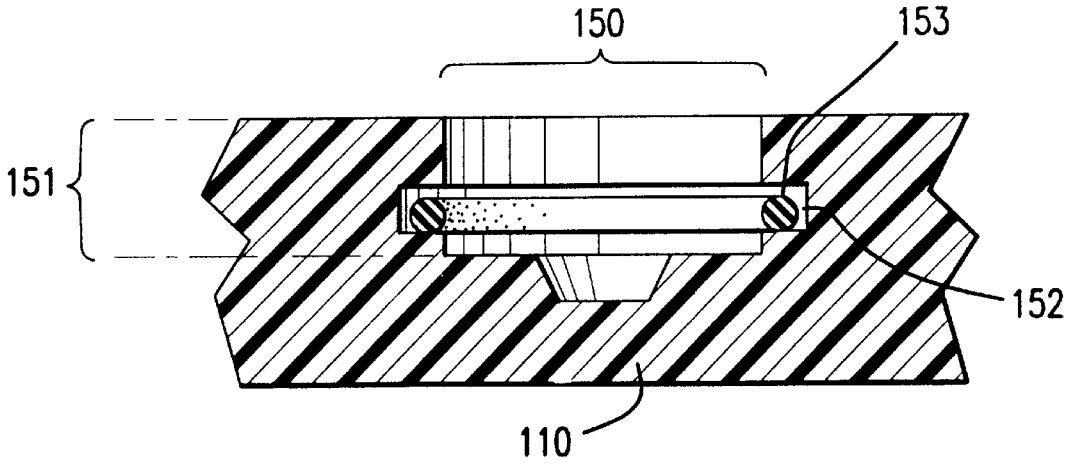
FIG. 7 illustrates a cross-sectional view along line 7 of a portion of the base for the storage and transport container shown in FIG. 1.

FIG. 7 illustrates a cross-sectional view along line 7 of a portion of the base for the storage and transport container shown in FIG. 1. As shown in FIG. 7, a lower retaining portion 150 has a depth 151. In some embodiments, a lower retaining portion 150 can have a socket 152; a device such as, for example, an o-ring 153, for example, can be located within socket 152. The o-ring 153 can assist an item 160 placed within lower retaining portion 150 to be secured in a more snug (i.e, tight fitting) manner.

Figure 8:
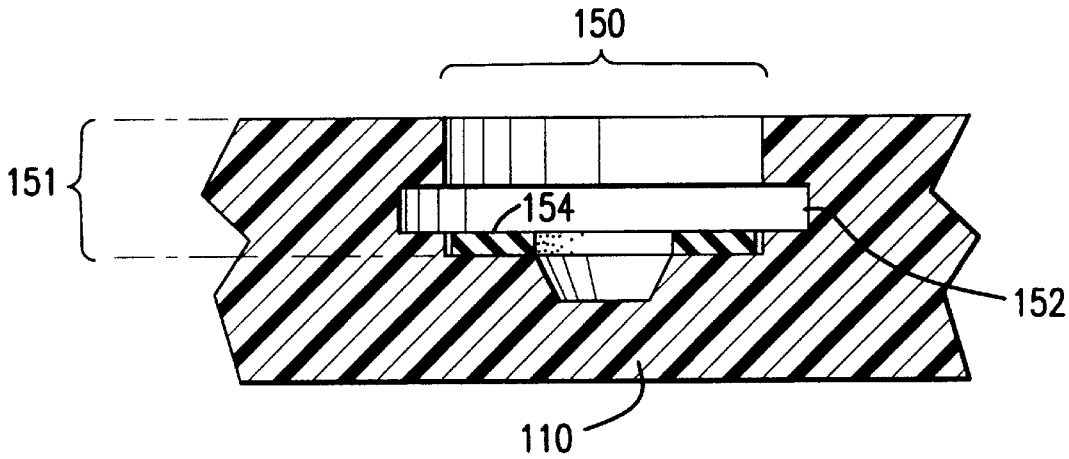
FIG. 8 illustrates a cross-sectional view along line 7 of a portion of the base with a cushion layer for the storage and transport container shown in FIG. 1.

FIG. 8 illustrates a cross-sectional view along line 7 of a portion of the base with a cushion layer for the storage and transport container shown in FIG. 1. In another embodiment, a cushion layer 154 can be located within the lower retaining portion 150, for example, at the bottom of the lower retaining portion 150. The cushion layer 154 can be made of any resilient material, such as silicon or rubber. An item 160 placed within the lower retaining portion 150 can be located on top of the cushion layer 154. When items 160 are secured within lower retaining portion 150 (i.e., when cover 120 is closed onto base 110), the cushion layer 154 can provide items 160 with a snug fit and absorb shock.

Figure 9:
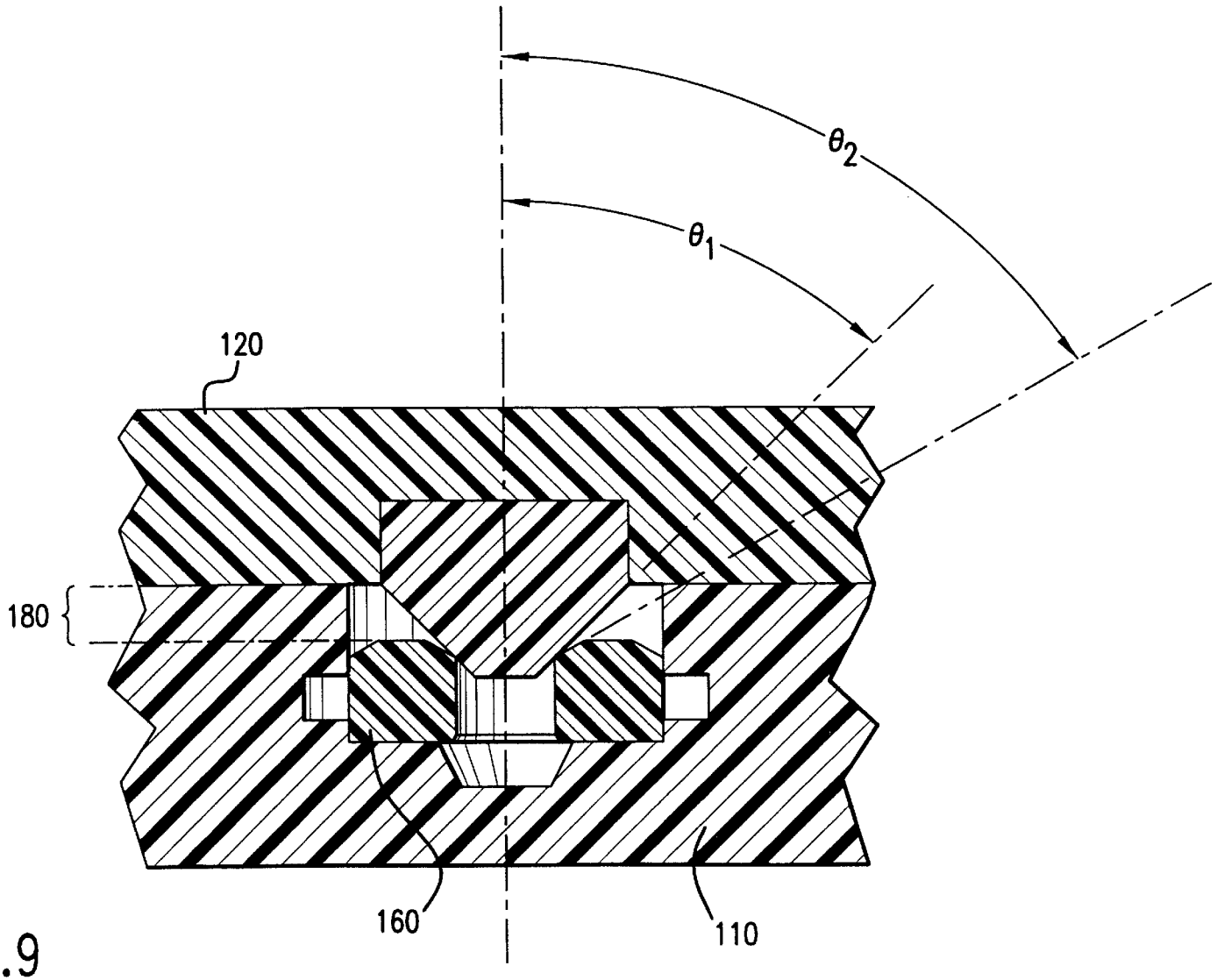
FIG. 9 illustrates a cross-sectional view along lines 7 and 9 where the item shown in FIG. 4 is located within a lower retaining portion of the base and an upper retaining portion of the cover, according to the storage and transport container shown in FIG. 1.

FIG. 9 illustrates a cross-sectional view along lines 7 and 9 where the item shown in FIG. 4 is located within a lower retaining portion of the base and an upper retaining portion of the cover, according to the storage and transport container shown in FIG. 1. The upper retaining portion 170 (see FIG. 2) of the cover 120 only contacts the contacting portion 162 (see FIG. 4) of item 160 by the contacting portion 171 (see FIG. 2). The non-contacting portion 172 of the upper retaining portion 170 of cover 120 does not contact the non-contacting portion 161 of item 160. In other words, no portion of the upper retaining portion 170 of cover 120 contacts the non-contacting portion 161 of item 160. The upper retaining portion 170 of cover 120 is separated from the non-contacting portion 161 of item 160 by a gap, for example the gap 180 shown in FIG. 9. The height of the lower retaining portion 150 of base 110 can be greater than the height of item 160 so that the non-contacting portion 161 of item 160 is separated from the upper retaining portion 150 of cover 120 by gap 180.

By selecting the incline angles of the contacting portion of the upper retaining portion and the contacting portion of the item, the nature of their contact can be controlled. For example, as shown in FIG. 9, the incline angle of the contacting portion 171 of upper retaining portion 170, labeled as $\theta_1$, can be less than the incline angle of the contacting portion 162 of item 160, labeled as $\theta_2$. In the example shown in FIG. 9, incline angle, $\theta_1$, is about 45 degrees and incline angle, $\theta_2$, is about 60 degrees. In this case, the contacting portion 171 contacts contacting portion 162 of item 160 at a point away from non-contacting portion 161 of item 160.

Figure 10:
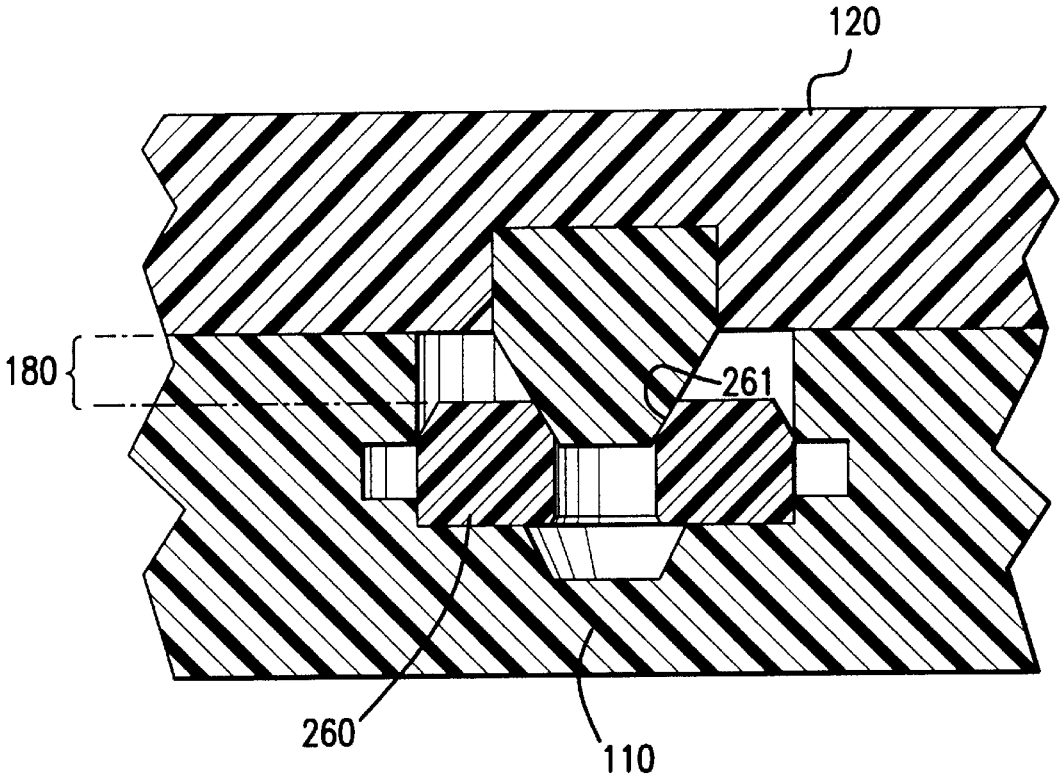
FIG. 10 illustrates a cross-sectional view of another embodiment of an item located within a lower retaining portion of the base and an upper retaining portion of the cover, according to the storage and transport container shown in FIG. 1.

Alternatively, the incline angles of the contacting portion of the upper retaining portion and the contacting portion of the item can be equal. FIG. 10 illustrates a cross-sectional view of another embodiment of an item located within a lower retaining portion of the base and an upper retaining portion of the cover, according to the storage and transport container shown in FIG. 1. In this example, the contacting portion 171 of upper retaining portion 170 contacts along the length of the non-contacting portion 161 of the item 260.

Figure 11:
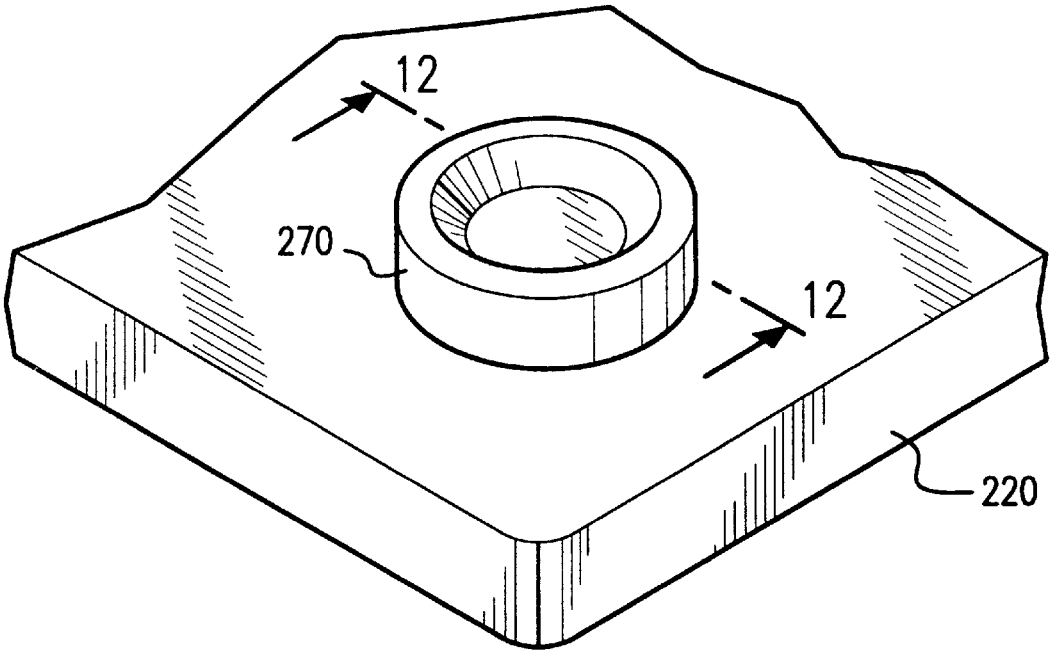
FIG. 11 shows an isometric view of a portion of a cover of a storage and transport container according to another embodiment of the present invention.
Figure 12:
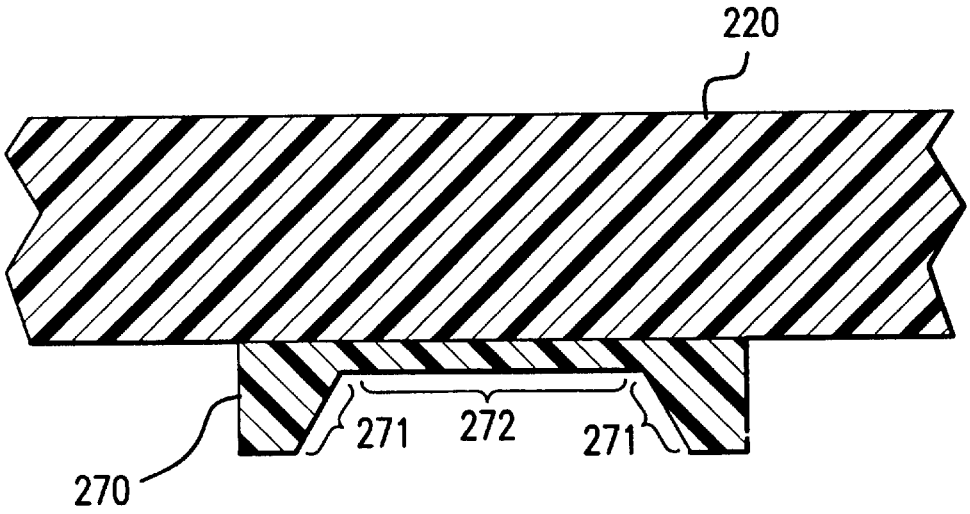
FIG. 12 shows a cross-sectional view along line 12 of a portion of the cover for the storage and transport container shown in FIG. 11.

FIG. 11 shows an isometric view of a portion of a cover of a storage and transport container according to another embodiment of the present invention. FIG. 12 shows a cross-sectional view along line 12 of a portion of the cover for the storage and transport container shown in FIG. 11. The cover 220 includes upper retaining portions 270 (although one is shown in FIG. 11, multiple upper retaining portions 270 is possible). Upper retaining portions 270 include contacting portions 271 and non-contacting portions 272.

Figure 13:
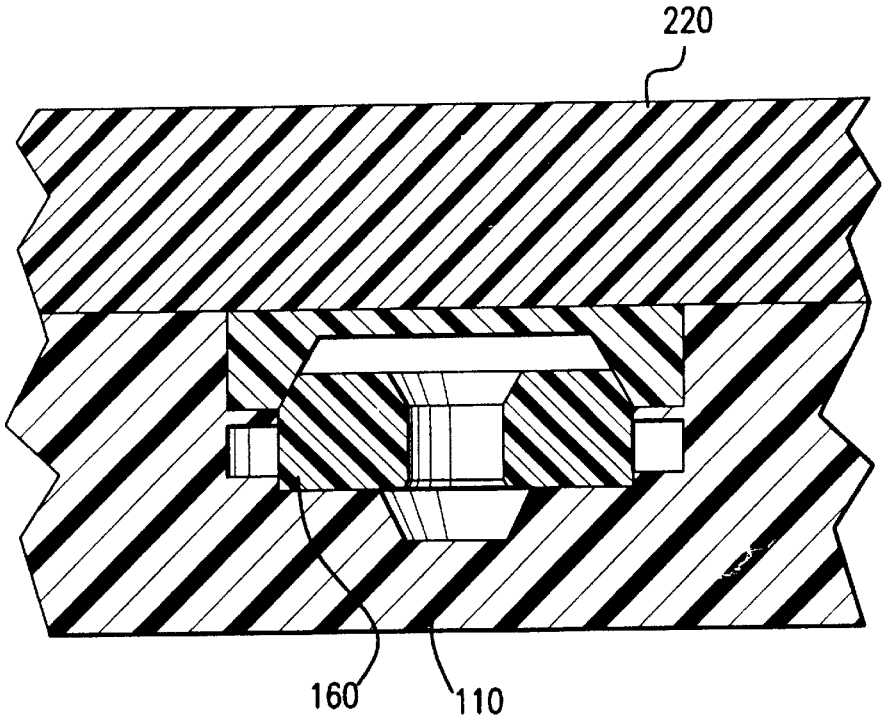
FIG. 13 illustrates a cross-sectional view along lines 5 and 12 where the item shown in FIG. 4 is located within a lower retaining portion of a base and an upper retaining portion of the cover, according to an embodiment of the present invention.

FIG. 13 illustrates a cross-sectional view along lines 5 and 12 where the item shown in FIG. 4 is located within a lower retaining portion of a base and an upper retaining portion of the cover, according to an embodiment of the present invention. The cover 220 corresponds to the cover shown in FIGS. 11 and 12. The upper retaining portion 270 of the cover 220 only contacts the contacting portion 162 of item 160 by contacting portions 271. The non-contacting portion 272 of the upper retaining portion 270 of cover 220 does not contact the non-contacting portion 161 of item 160.

Figure 14:
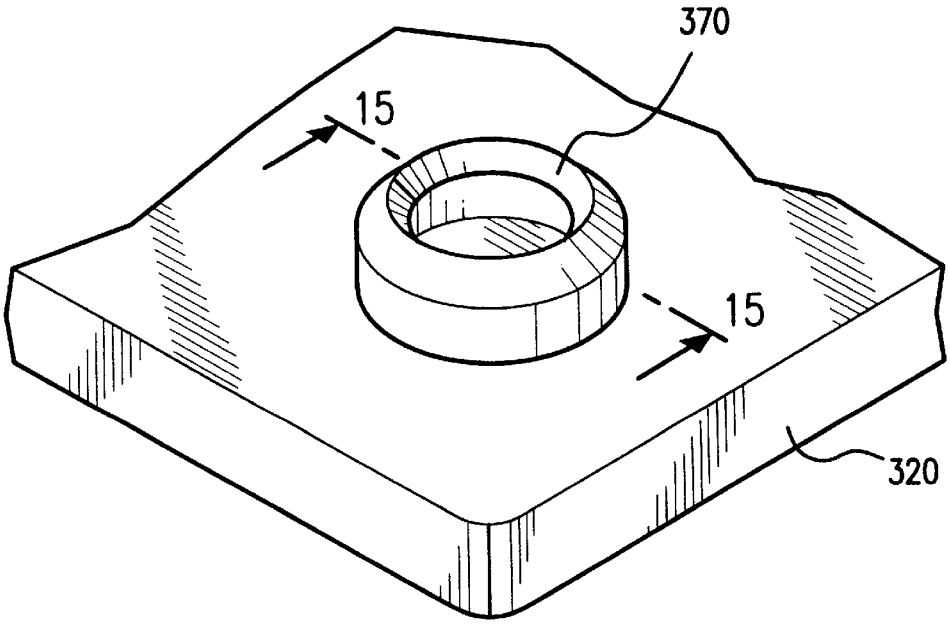
FIG. 14 shows an isometric view of a portion of a cover of a storage and transport container according to yet another embodiment of the present invention.
Figure 15:
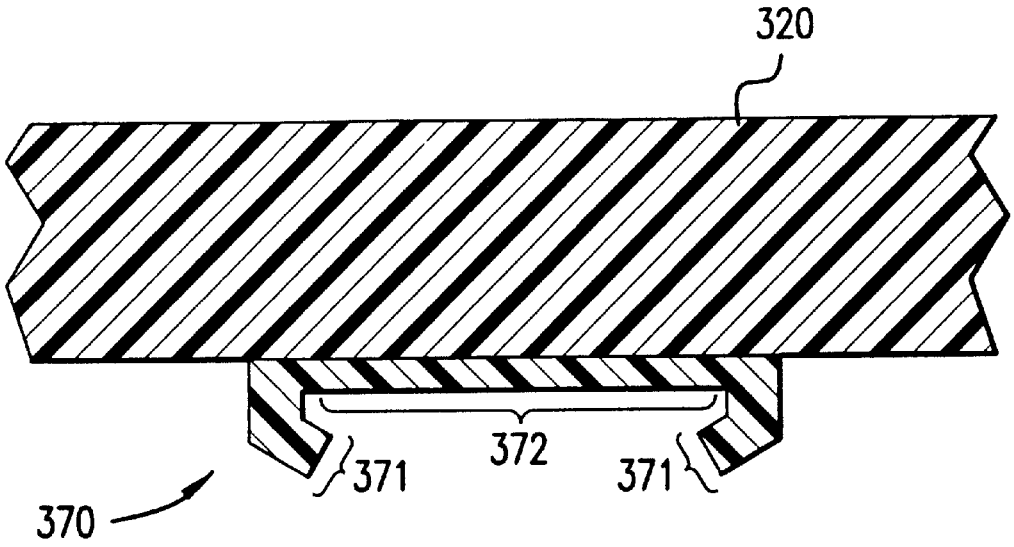
FIG. 15 shows a cross-sectional view along line 15 of a portion of the cover for the storage and transport container shown in FIG. 14.

FIG. 14 shows an isometric view of a portion of a cover of a storage and transport container according to yet another embodiment of the present invention. FIG. 15 shows a cross-sectional view along line 15 of a portion of the cover for the storage and transport container shown in FIG. 14. The cover 320 includes upper retaining portions 370 (although one is shown in FIG. 14, multiple upper retaining portions 270 is possible). Upper retaining portions 370 include contacting portions 371 and non-contacting portions 372.

Figure 16:
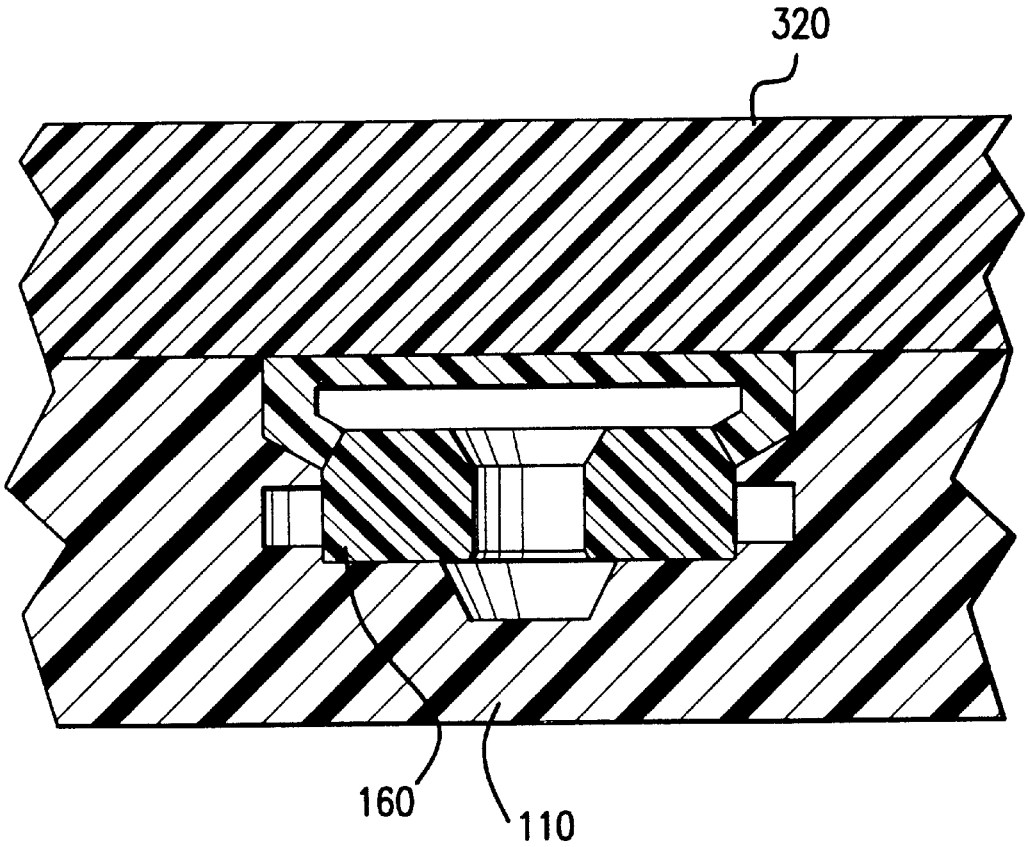
FIG. 16 illustrates a cross-sectional view along lines 5 and 15 where the item shown in FIG. 4 is located within a lower retaining portion of a base and an upper retaining portion of the cover, according to an embodiment of the present invention.

FIG. 16 illustrates a cross-sectional view along lines 5 and 15 where the item shown in FIG. 4 is located within a lower retaining portion of a base and an upper retaining portion of the cover, according to an embodiment of the present invention. The cover 320 corresponds to the cover shown in FIGS. 14 and 15. The upper retaining portion 370 of the cover 320 only contacts the contacting portion 162 of item 160 by contacting portions 371. The non-contacting portion 372 of the upper retaining portion 370 of cover 320 does not contact the non-contacting portion 161 of item 160.

As FIGS. 11 through 16 illustrate, many configurations for the retaining portions of a cover are possible. The retaining portions can be configured so that items are protected by a retaining portion of the cover being positioned above one item and in contact with a contactable portion of the item without contacting a particular surface or section of the item.

It should, of course, be understood that while the present invention has been described in reference to particular configurations, other configurations should be apparent to those of ordinary skill in the art. For example, although a particular configuration of the item to be stored and/or transported, other configurations are possible. For example, the item can have shapes other than circular, such as rectangular, triangular, oval, or any type of polygon. The shapes and areas of the upper surface contacting portions and non-contacting portions of the items can vary. For example, the contacting portion of an item and of the cover can be configured so that either the contact occurs at a point or along an extended area. Similarly, the shapes and areas of the contacting portions and non-contacting portions of the upper and lower retaining portions can correspondingly vary.

What is claimed is:

1. A container for holding an item having an upper surface with a contacting portion and a substantially planar non-contacting portion, comprising:

a base having a lower retaining portion with a depth, the item being removably engagable into the lower retaining portion of said base;

a cover having an upper surface and a lower surface, the lower surface further including at least one upper retaining portion consisting of a conical contacting portion extending therefrom and a non-contacting portion, said cover being removably engagable with said base so that the upper retaining portion of said cover is aligned with the lower retaining portion of said base, the conical contacting portion of the upper retaining portion of said cover would engage the contacting portion of the item and the non-contacting portion of the upper retaining portion would be maintained separated from the substantially planar non-contacting portion of the item by a gap.

2. The container of claim 1, wherein the contacting portion of the upper retaining portion of said cover would to reasonably engage the contacting portion of the item without the non-contacting portion of the upper retaining portion contacting the substantially planar non-contacting portion of the item.

3. The container of claim 1, wherein the contacting portion of the upper retaining portion would engage the contacting portion of the item at an angle.

4. The container of claim 1, wherein the contacting portion of the upper retaining portion of said cover is dimensioned to contact the contacting portion of the item along a line of contact.

5. The container of claim 1, wherein the contacting portion of the upper retaining portion has a first incline angle, the contacting portion of the item having a second incline angle substantially equal to the first incline angle.

6. The container of claim 1, wherein the depth of the lower retaining portion of said base is greater than a height of the item.

7. The container of claim 1, further comprising:

an o-ring disposed within a socket of the lower retaining portion of said base, the o-ring having an interior hole dimensioned accommodate a portion of the item.

8. The container of claim 1, further comprising:

a cushion layer disposed within the lower retaining portion of said base.

9. A method for holding an item within a container having a base and a cover, the item having an upper surface with a contacting portion and a substantially planar non-contacting portion, a cover having an upper retaining portion consisting of a conical contacting portion extending therefrom and a non-contacting portion, said method comprising:

(a) removably engaging the item into a lower retaining portion of said base, the lower retaining portion of said base having a depth; and (b) removably engaging said cover onto said base so that:

(i) the upper retaining portion of said cover is aligned with the lower retaining portion of said base, (ii) the conical contacting portion of the upper retaining portion of said cover contacts the contacting portion of the item, and (iii) the non-contacting portion of the upper retaining portion is maintained separated from the substantially non-contacting portion of the item by a gap.

10. The method of claim 9, further comprising:

(c) clamping said cover to said base by a clamping member so that the contacting portion of the item is removably engaged with the contacting portion of the upper retaining portion of said cover without the non-contacting portion of the upper retaining portion of said cover contacting the non-contacting portion of the item.

11. The method of claim 9, wherein:

the contacting portion of the upper retaining portion engages the contacting portion of the item at an angle.

12. The method of claim 9, wherein the contacting portion of the upper retaining portion of said cover contacts the contacting portion of the item along a line of contact.

13. The method of claim 9, wherein:

the contacting portion of the upper retaining portion of said cover has a first incline angle, the contacting portion of the item has a second incline angle such that it would be substantially equal to the first incline angle.

* * * * *